US008408036B2

(12) United States Patent
Reith et al.

(10) Patent No.: US 8,408,036 B2
(45) Date of Patent: Apr. 2, 2013

(54) EDGE CURLING TOOL

(75) Inventors: Stefan Reith, Hofbieber (DE); Detlef Todzey, Fulda (DE); Albert Ritz, Eichenzell (DE)

(73) Assignee: FFT Edag Produktionssysteme GmbH & Co. KG, Fulda (DE)

( * ) Notice: Subject to any disclaimer, the term of this patent is extended or adjusted under 35 U.S.C. 154(b) by 538 days.

(21) Appl. No.: 12/601,624

(22) PCT Filed: May 30, 2008
(Under 37 CFR 1.47)

(86) PCT No.: PCT/EP2008/004338
§ 371 (c)(1),
(2), (4) Date: May 24, 2010

(87) PCT Pub. No.: WO2008/145396
PCT Pub. Date: Dec. 4, 2008

(65) Prior Publication Data

US 2010/0242561 A1 Sep. 30, 2010

(30) Foreign Application Priority Data

Jul. 1, 2007 (DE) ..... 20 2007 007 838 U

(51) Int. Cl.
*B21D 7/02* (2006.01)

(52) U.S. Cl. ..... 72/214; 72/21.4; 72/433; 72/482.91

(58) Field of Classification Search ..... 72/210, 72/214, 220, 433, 434, 444, 482.91, 20.1, 72/21.4; 29/243.5, 243.523, 243.57, 243.58
See application file for complete search history.

(56) References Cited

U.S. PATENT DOCUMENTS

| | | | | |
|---|---|---|---|---|
| 5,228,190 | A * | 7/1993 | Sawa | 29/715 |
| 6,983,633 | B2 * | 1/2006 | Holmgren et al. | 72/220 |
| 7,124,611 | B2 * | 10/2006 | Baulier et al. | 72/220 |
| 7,152,292 | B2 * | 12/2006 | Quell et al. | 29/243.5 |
| 7,254,973 | B2 * | 8/2007 | Campian | 72/220 |
| 7,290,423 | B2 * | 11/2007 | Carsley et al. | 72/214 |
| 7,500,373 | B2 * | 3/2009 | Quell | 72/214 |
| 7,637,134 | B2 * | 12/2009 | Burzlaff et al. | 72/220 |

(Continued)

FOREIGN PATENT DOCUMENTS

| | | |
|---|---|---|
| DE | 100 11 854 | 9/2001 |
| DE | 10 2004 042213 | 3/2006 |

(Continued)

*Primary Examiner* — Dana Ross
*Assistant Examiner* — Leonel Vasquez
(74) *Attorney, Agent, or Firm* — RatnerPrestia

(57) ABSTRACT

A roll-flanging tool, including a bearing structure having a connector, by which the tool can be connected via a connection plane to an actuator which can be moved spatially. A first arm and a second arm are spread apart from each other and connected to each other in a connection portion which includes the connector. A first flanging roller is mounted on an end of the first arm which faces away from the connection plane, such that it can be rotated about a first rotational axis which extends along the first arm and pierces the connection plane. A second flanging roller is mounted on an end of the second arm which faces away from the connection plane, such that it can be rotated about a second rotational axis. The first rotational axis intersects or crosses a perpendicular dropped onto the second rotational axis, in or on the roll-flanging tool.

9 Claims, 5 Drawing Sheets

U.S. PATENT DOCUMENTS

| | | | | |
|---|---|---|---|---|
| 8,015,688 | B2 * | 9/2011 | Chen et al. | 29/509 |
| 2005/0015955 | A1 | 1/2005 | Quell et al. | |
| 2005/0086989 | A1 | 4/2005 | Holmgren et al. | |
| 2005/0217339 | A1 * | 10/2005 | Toeniskoetter | 72/220 |
| 2006/0288752 | A1 | 12/2006 | Burzlaff et al. | |
| 2008/0245124 | A1 * | 10/2008 | Chaker et al. | 72/214 |

FOREIGN PATENT DOCUMENTS

| | | |
|---|---|---|
| EP | 1 420 908 | 5/2004 |
| EP | 1 518 616 | 3/2005 |
| EP | 1 685 915 | 1/2006 |

* cited by examiner

EDGE CURLING TOOL

This application is the U.S. national phase application of PCT International Application No. PCT/EP2008/004338, filed May 30, 2008, which claims priority to German Patent Application No. DE 20 2007 007 838.2, filed Jun. 1, 2007, the contents of such applications being incorporated by reference herein in their entirety.

BACKGROUND OF THE INVENTION

1. Technical Field

The invention relates to a roll-flanging tool for flanging component parts, preferably for producing hemmed connections between two or more component parts. The tool is or can be fastened to an actuator which can be moved spatially, for example an end of an arm of an industrial robot, or other framework which is comparable with regard to the connection. The tool can in particular be used in the manufacture of vehicles and vehicle parts, preferably in the series production of automobiles.

2. Description of the Related Art

In automobiles, particular regions of the body, for example wheel arches, or attachment parts, for example sunroofs, engine bonnets and mudguards, are flanged in order to fixedly connect an inner part and an outer part of the body or attachment part in question to each other by means of a hemmed connection. The flanged component part—generally the outer part—is usually a metal sheet part. During flanging, a flanging roller travels a peripheral strip of the component part to be flanged, in the longitudinal direction, and folds over a flanging web which includes the periphery of the peripheral strip. If, for example, the flanging web is folded over by 90°, this is achieved in a plurality of consecutive flanging steps, as is described in EP 1 420 908 B1 for roll-flanging in a plurality of processing runs to be performed consecutively and in EP 1 685 915 for successively folding over in one processing run. Component parts in which the peripheral strip, along which a flanging web is to be folded over, points at an angle to an adjacent region of the component part, and in which the angular position of the peripheral strip changes in the longitudinal direction, are for example problematic with respect to accessibility and consequently the freedom of movement of an actuator bearing a roll-flanging tool. Thus, in one longitudinal portion, the peripheral strip can for example enclose an angle of 90° with the region of the component part which is adjacent in said portion, while another longitudinal portion encloses another angle with the region of the component part which is adjacent in said portion or for example simply extends the region in question in a straight line. The peripheral strip can be continuously twisted in the longitudinal direction, such that the angular position with respect to the adjacent peripheral region continuously changes, or can comprise longitudinal portions which are offset from each other in the longitudinal direction or border each other discontinuously in respectively different angular positions. Such a profile of the peripheral strip can for example be exhibited by engine bonnets which are trough-shaped in cross-section and extend via their trough peripheries into the side regions of the body, in order to reduce the risk of injury to pedestrians in the event of collisions. If a flanging roller moves along such a peripheral strip, the flanging tool has to follow the different angular positions of the peripheral strip and correspondingly has to be rotated or pivoted about an axis parallel to the longitudinal direction. In addition, the angular position of the tool also generally has to be altered in the course of the flanging steps which are to be successively performed, wherein the tool as a whole is often cumbersome.

In order to flange peripheral strips having a profile which is complex in this sense, it is possible to use flanging tools comprising a plurality of flanging rollers. In this way, it is possible to flange different longitudinal portions using different flanging rollers. However, flanging tools of this type are in many cases voluminous and problematic if the space available is restricted. Not only the plurality of flanging rollers but also supporting them on a bearing structure of the tool contribute to the volume of the tool.

Flanging rollers for closing a hem—so-called final flanging rollers—are advantageously supported spring-elastically. An example of a preferred support of this type is known from DE 100 11 854 A1. The spring-elastic support likewise increases the volume of the tool and increases the complexity and accordingly also the price.

SUMMARY OF THE INVENTION

It is an object of the invention to make it easier to flange a component part along a peripheral strip which exhibits different angular positions with respect to an adjacent region of the component part in the longitudinal direction, and to provide a roll-flanging tool which fulfills this object.

Another object is to simplify a roll-flanging tool, which is fitted with a plurality of spring-elastically supported flanging rollers, with regard to its spring-elastic support, preferably in order to obtain a tool geometry which is favorable to solving the above object.

The subject of an exemplary embodiment of the invention includes a roll-flanging tool which comprises a bearing structure, a first flanging roller which is mounted by the bearing structure such that it can be rotated about a first rotational axis, and a second flanging roller which is mounted by the bearing structure such that it can be rotated about a second rotational axis. The fact that the bearing structure mounts a component of the tool, for example a flanging roller, includes both the scenario in which it is directly mounted by the bearing structure and the scenario in which it is indirectly mounted by the bearing structure via one or more other structure(s). The bearing structure forms a connection means, by means of which the tool can be or already is connected to an actuator which can be moved spatially. The actuator can in particular be an arm or the end of an arm of an industrial robot. The connection means comprises a connection area, preferably a connection plane, via which it contacts the actuator when connected. If the connection area of the bearing structure is not level, then a separating plane conceived as a substitute between the actuator and the bearing structure is understood to represent the connection plane in the sense of the invention, wherein this conceived connection plane points at a right angle to a direction in which the bearing structure is pressed against the actuator when connected.

In accordance with an aspect of the invention, the tool comprises a first arm and a second arm which are spread apart from each other and connected to each other in a connection portion. The connection means is formed in the connection portion. Preferably, the bearing structure itself already comprises arms which are part of the arms of the tool. In preferred, simple embodiments, the arms of the bearing structure cannot move relative to each other. The bearing structure can as a whole be a structure which is rigid in its own right, which is not least advantageous for absorbing the forces which are to be absorbed during flanging. The arms of the tool and also the optional arms of the bearing structure can in particular point in a V shape with respect to each other and together with the adjacent connection portion form a Y-shaped tool and preferably also a Y-shaped bearing structure.

Furthermore, the first flanging roller is arranged on an end of the first arm which faces away from the connection plane, and the second flanging roller is arranged on an end of the second arm which faces away from the connection plane, either directly on arms of the bearing structure or respectively via a transmission means which is supported on the bearing structure and preferably respectively extends an arm of the bearing structure. The flanging rollers or at least one of the flanging rollers is/are preferably arranged in the extension of the respectively assigned arm.

The rotational axes of the flanging rollers are orientated in a particular way relative to each other and to the connection plane. Starting from the first flanging roller, the rotational axis of the first flanging roller runs through the tool and pierces the connection plane. The second rotational axis, by contrast, is orientated such that a straight line which intersects it at a right angle, i.e. a perpendicular dropped onto the second rotational axis, extends through the tool from the second rotational axis, pierces the connection plane and crosses or preferably intersects the first rotational axis in or on the tool. The first rotational axis and the perpendicular preferably extend through the connection portion or at least overlap with it. They also preferably intersect or cross each other in the connection portion or in a region which overlaps with it.

Due to the projecting arms, which are spread apart from each other, and the orientation of the rotational axes of the flanging rollers, the tool can optionally bring the first or the second flanging roller to bear by pivoting them about an axis, in order to fold over a flanging web in a peripheral strip or to successively fold over a plurality of flanging webs in a peripheral strip which are directly consecutive or staggered, in a plurality of flanging steps, even if the respective peripheral strip exhibits different angular positions with respect to the respectively adjacent region of the component part in the longitudinal direction, i.e. in the rolling direction of the respective flanging roller. The first flanging roller is thus in particular suitable for folding over a flanging web in a peripheral strip which points at an angle to the adjacent region of the component part via a radius, wherein the radius can form a sharp edge or a gently curved transition.

If the space available at the flanging location is restricted, it is particularly advantageous if the first flanging roller extends the first arm of the tool in the manner of a finger. The second flanging roller can in particular be used for flanging in peripheral strips which extend a larger adjacent region of the component part in a straight line or point at an obtuse angle of more than 90° to the adjacent region, such that the adjacent region of the component part does not obstruct the tool, at least not appreciably.

Preferably, the flanging rollers protrude freely. In such embodiments, the first flanging roller is freely accessible over a complete circumference about the first rotational axis, over the axial length of its rolling or flanging area, i.e. the tool does not comprise any other structure which axially overlaps with the rolling area of the first flanging roller. However, embodiments in which the rolling area of the first flanging roller is freely accessible as viewed from the second flanging roller are also advantageous. Lastly, an embodiment in which at least the side of the rolling area of the first flanging roller which faces away from the second flanging roller is freely accessible is also regarded as being advantageous. The same applies analogously to the second flanging roller, i.e. in preferred embodiments, its rolling area protrudes in an extension of the second arm of the tool beyond all the other structures of the tool in this region, freely accessible from all sides, or is at least not axially overlapped up to its front end by another structure of the tool in the region between the two arms, i.e. towards the first flanging roller.

An exemplary embodiment of the invention also includes a roll-flanging tool which comprises: a bearing structure comprising a connection means for a connection to an actuator which can be moved spatially; a first flanging roller; a second flanging roller; and a spring, mounted by the bearing structure, for the two flanging rollers together. The bearing structure mounts the first flanging roller such that it can be rotated about a first rotational axis and moved transverse to the first rotational axis against a restoring force of the spring. The bearing structure also mounts the second flanging roller such that it can be rotated about a second rotational axis and moved transverse to the second rotational axis against a restoring force of the same spring. The tool is advantageously formed as explained above, but can in principle also have no arms or be fitted with only one of the arms. By supporting both flanging rollers on the same spring, at least one spring and also some of the other structures necessary for such an elastically movable support are saved as compared to individually supported flanging rollers, such as would for example be comprised by a tool having two flanging rollers which are respectively supported as known from DE 100 11 854 A1. Conversely, the support in accordance with the invention can advantageously be developed from the support described in said document for a single flanging roller only.

In preferred embodiments, the tool comprises a first transmission means, which is movably connected to the bearing structure, for the first flanging roller and a second transmission means, which is likewise movably connected to the bearing structure, for the second flanging roller. The first flanging roller is supported on the first transmission means such that it can be rotated about its rotational axis, and the second flanging roller is supported on the second transmission means such that it can be rotated about its rotational axis. The first transmission means is movably connected to the bearing structure, such that it transmits a flanging force—which acts on the first flanging roller, transverse to the first rotational axis, during flanging—onto the spring, against the force of the spring, in a first direction. The second transmission means can move relative to the bearing structure in such a way that it transmits the flanging force—which acts on the second flanging roller, transverse to the second rotational axis, during flanging—onto the spring, against the force of the spring. The spring is thus tensed during flanging, either by the first flanging roller via the first transmission means or by the second flanging roller via the second transmission means, with a force which corresponds to the respective flanging force or is proportional to the respective flanging force. The second transmission means preferably transmits the flanging force of the second flanging roller onto the spring in a counter direction opposite to the first direction. In such embodiments, the spring is thus charged along a spring axis in one axial direction by one flanging roller and in the opposite axial direction by the other flanging roller.

The spring is preferably installed with a bias which is large enough that it only elastically deflects under the forces which usually act during flanging when the respective flanging roller is being used in a last flanging step as a final flanging roller, while the spring does not yield and acts as a rigid abutment in one or more primary flanging step(s) prior to final flanging.

Orientating the rotational axes of the flanging rollers as described above facilitates the support via the common spring. The flanging force to be absorbed as a reaction force by the first flanging roller during flanging can advantageously be transmitted onto the spring along the perpendicular dropped onto the second rotational axis. For this purpose, the second transmission means can be connected to the bearing structure such that it can be linearly moved—guided and secured against rotating—back and forth along the perpendicular. The flanging force to be absorbed by the first flanging roller during flanging acts as a lateral force in accordance with the orientation of the first rotational axis and can be introduced into the bearing structure as a bending force. The first transmission means is preferably connected to the bearing structure such that it can be pivoted about a pivoting axis which points transverse to the first rotational axis, such that the flanging force to be absorbed by the first flanging roller is likewise introduced into the spring at least substantially parallel to the perpendicular dropped onto the second rotational axis, via a lever arm of the transmission means. For this purpose, the transmission means is expediently formed as a pivoting lever comprising a first lever arm extending from the pivoting axis to the center of force of the first flanging roller, and a second lever arm extending from the pivoting axis to the opposite side, up to a point at which the force acts along a spring axis and the direction is preferably adapted, for example in a sliding contact. The first lever arm and the second lever arm can in particular be of the same length. "Lever arms" is understood to mean the mathematical lever arms. The two mathematical lever arms and preferably also the actual, material lever arms can extend each other beyond the pivoting axis, respectively flush in a straight line, i.e. they can form a straight pivoting lever; however, this is not absolutely necessary. Using lever arms of the same length, the force acting on the first flanging roller during flanging is transmitted 1:1, i.e. without being stepped-up or stepped-down, onto the spring.

In preferred embodiments, the spring is supported via a load cell, by means of which the force absorbed by the spring during flanging is measured. It is also advantageous if a setting means is provided for setting the bias of the spring. In alternative embodiments, however, the load cell can also be used to measure the force absorbed by the spring during flanging, in particular during final flanging, and the actuator can be controlled in accordance with the measurement value, such that the flanging roller which is respectively being used is pressed against the flanging web of the component part with a flanging force which is predetermined by an actuator control. The load cell is preferably arranged such that both the first flanging roller and the second flanging roller acts on the load cell via the common spring, i.e. on the load cell which in this case is likewise a common load cell. Instead of a load cell, another sensor can also be used to measure or ascertain the respective force, for example a pressure sensor, force sensor, compression and/or strain sensor or a position sensor, using which a measurement variable which is representative of the force acting on the spring can be measured.

In preferred flanging methods, the flanging rollers are respectively used as a primary flanging roller and a final flanging roller. The flanging rollers thus roll off a flanging web in one or more primary flanging step(s) in order to fold it over by an angle which is predetermined by the angular position of the rotational axis of the respective flanging roller. They also roll off the flanging web, which has been folded over by primary flanging, in a concluding final flanging step in which the flanging web is completely folded over and, once the final flanging step has been performed, is folded over by 180° with respect to the region of the peripheral strip which is adjacent via the flanging edge. The invention also relates to a method in which a component part is folded over along a peripheral strip which exhibits changing angular positions with respect to an adjacent region of the component part. For flanging, the first flanging roller is used in a first longitudinal portion of the peripheral strip, and the second flanging roller is used in another longitudinal portion of the peripheral strip. The two flanging rollers are respectively used in at least one run for primary flanging and one concluding run for final flanging in the respective longitudinal portion of the peripheral strip. For this purpose, the flanging rollers are respectively supported on the bearing structure, such that they can be elastically moved, via a separate spring or preferably via the common spring described. The springs or the preferably common spring are/is assembled with a bias which is large enough that it preferably does not yield during the respective primary flanging step or the plurality of primary flanging steps per flanging roller but rather acts as a hard abutment and only elastically deflects under the larger pressing force during final flanging.

In preferred embodiments, the bearing structure forms a housing in which one or more components of the tool is/are accommodated or into which one or more components protrude, for example said spring or one or both of the transmission means. In principle, however, the bearing structure can also merely form a framework in the broader sense, on which the flanging rollers or other components of the tool are exteriorly supported. The fact that the first rotational axis intersects or crosses the perpendicular dropped onto the second rotational axis in or on the tool accordingly means that the intersection point or the two points nearest to each other in the crossing region is/are in or on the tool. The intersection point or the points nearest to each other in the crossing region is/are preferably in or on the bearing structure and even more preferably in or on the connection portion of the bearing structure.

The rotational axis of the first flanging roller can point at a right angle to the connection plane. It preferably points obliquely with respect to the connection plane. The inclination is advantageously selected such that the first rotational axis pierces the connection plane in the region of the connection means. These statements preferably likewise apply to the perpendicular dropped onto the rotational axis of the second flanging roller.

BRIEF DESCRIPTION OF THE DRAWINGS

An example embodiment of the invention is explained below on the basis of figures. Features disclosed by the example embodiment, each individually and in any combination, advantageously develop the subjects of the claims and the embodiments described above. There is shown:

DETAILED DESCRIPTION OF THE PREFERRED EMBODIMENTS

Figure 1:
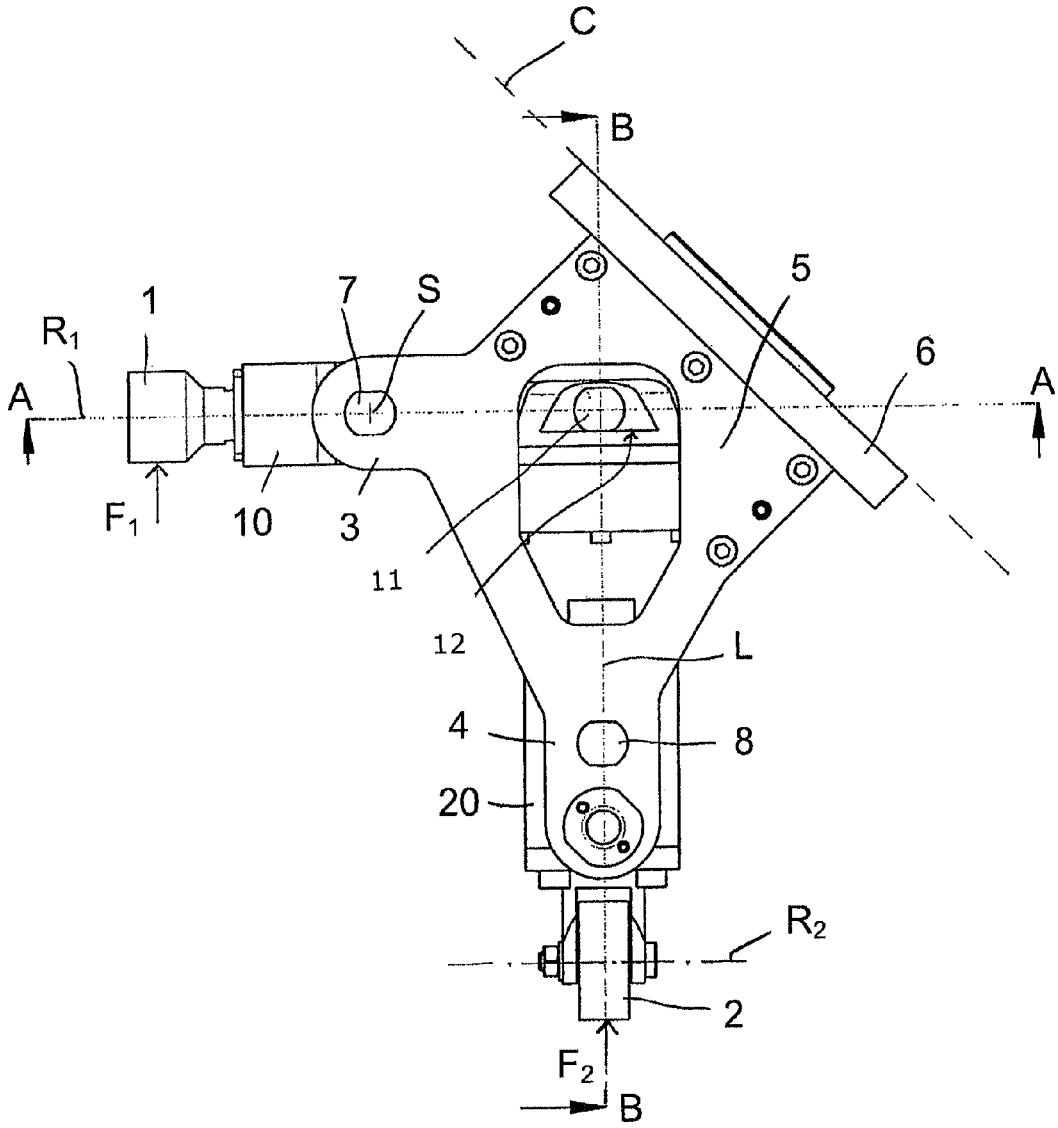
FIG. 1 a roll-flanging tool in a lateral view.
Figure 2:
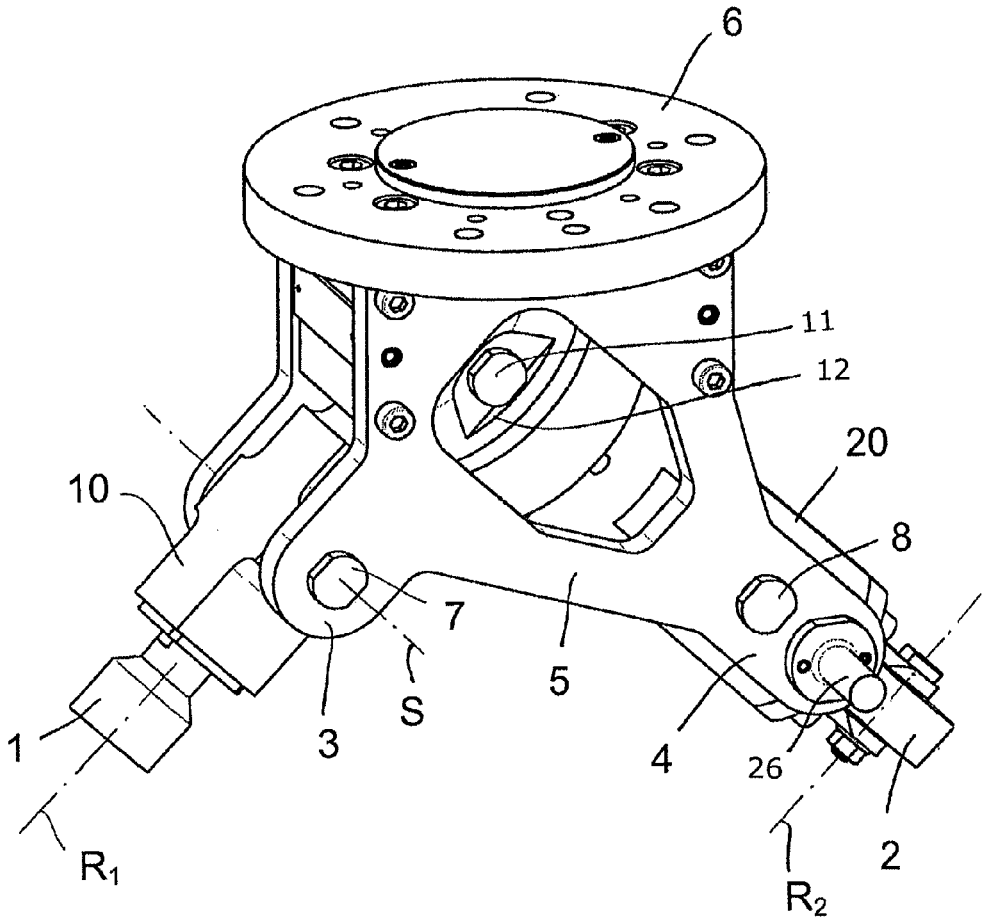
FIG. 2 the roll-flanging tool in a perspective view.

FIGS. 1 and 2 show a roll-flanging tool in a lateral view and a perspective view. The tool is designed as a tool head for an industrial robot or other actuator which can be moved spatially in a comparable way. It comprises a first flanging roller 1, a second flanging roller 2 and a bearing structure which serves as a fixed framework and mounts the components of the tool, in particular the flanging rollers 1 and 2. The tool does not comprise any other flanging rollers beyond the flanging rollers 1 and 2. The flanging roller 1 is supported on the bearing structure such that it can be pivoted by means of the transmission means 10, and the flanging roller 2 is supported on the bearing structure such that it can be linearly moved by means of the transmission means 20. The tool is at least suitable for being connected to an actuator of said type.

The bearing structure comprises a first arm 3 and a second arm 4, as well as a connection portion 5 from which the arms 3 and 4 project, such that in the lateral view in FIG. 1 they roughly form a "Y" together with the connection portion 5, and a connection means 6 which is arranged on the end of the connection portion 5 facing away from the arms 3 and 4. The tool is connected, in particular fastened, to the actuator by means of the connection means 6. The connection means 6 is shaped as a connection flange having a planar connection area. The flange plane, which when fastened contacts the actuator or a framework which is comparable in relation to the connection, forms a connection plane C, wherein the connection plane C is understood to represent not only the contact area of the connection means 6 but rather the entire plane which includes this area.

The bearing structure is substantially composed of two bearing plates arranged at a distance from each other, and transverse reinforcements which transversely reinforce the bearing plates against each other and which also include the connection means 6. The bearing plates each exhibit the same shape and form the two arms 3 and 4 which are spread apart from each other.

The flanging roller 1 is mounted such that it can be rotated about a rotational axis $R_1$, and the flanging roller 2 is mounted such that it can be rotated about a rotational axis $R_2$. As viewed from the flanging roller 1, the rotational axis $R_1$ extends through the bearing structure 3-6, in the example embodiment through the arm 3 and the connection portion 5, and then pierces the connection plane C, in the example embodiment the contact area of the connection means 6. The rotational axis $R_2$ of the second flanging roller 2 is orientated such that an axis L which intersects the rotational axis $R_2$ at a central point of the flanging roller 2, i.e. the perpendicular dropped onto the rotational axis $R_2$ at said point, extends through the second arm 4 and the connection portion 5, as viewed from the flanging roller 2, and likewise pierces the connection plane C—in the example embodiment, likewise the contact area of the connection means 6. The axis L also intersects the rotational axis $R_1$ in the region of the overlap with the connection portion 5, i.e. within a housing formed by the bearing structure 3-6 in the region of the connection portion 5. The rotational axis $R_1$ and the axis L enclose an angle of 90° with each other. The rotational axes $R_1$ and $R_2$ together span a plane which forms the plane of view in FIG. 1. In the example embodiment, the rotational axes $R_1$ and $R_2$ are parallel to each other. The axis L lies in the same plane. In one modification, the second flanging roller 2 can be arranged such that its rotational axis $R_2$ assumes a different rotational angular position with respect to the axis L, while the orientation of the axes L and $R_1$ is unchanged. Although the rotational angular position selected in the example embodiment is a preferred rotational angular position, the rotational axis $R_2$ can be rotated about the axis L, for example by an angle of 90°.

The transmission means 10 is supported on the bearing structure 3-6, in the example embodiment on the arm 3, such that it can be pivoted about a pivoting axis S, which extends in a transverse direction with respect to the rotational axis $R_1$, in a rotary joint. In the example embodiment, it intersects the rotational axis $R_1$ at a right angle. It also points at a right angle to the axis L. The transmission means 10 forms a pivoting lever comprising a first lever arm extending from the pivoting axis S to a center of force of the flanging roller 1, and a second lever arm extending from the pivoting axis S to the other side. In the example embodiment, the transmission means 10 is formed as a two-armed pivoting lever, and the two lever arms extend along the rotational axis $R_1$. Accordingly, the lever arm which points from the pivoting axis S towards the connection means 6 intersects the axis L dropped onto the rotational axis $R_2$.

The transmission means 20 is guided, such that it can be linearly moved back and forth along the axis L, in a prismatic joint relative to the bearing structure, in the example embodiment on the arm 4. The two transmission means 10 and 20 extend the respective arm 3 or 4, such that the arm assemblies composed of the arms 3 and 4 of the bearing structure and the respective transmission means 10 and 20 are obtained as the arms of the tool.

Figure 3:
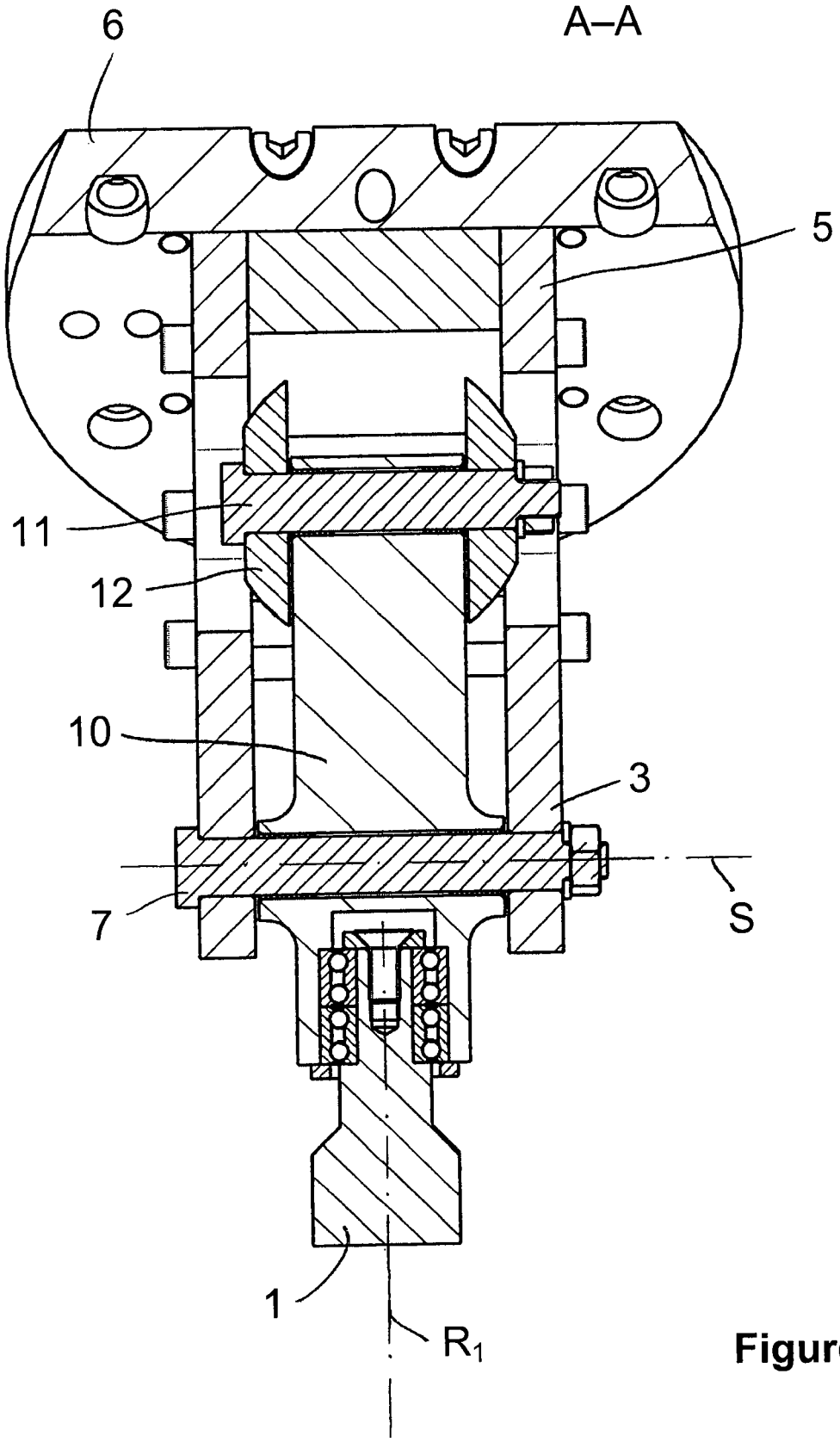
FIG. 3 the section A-A in FIG. 1.

FIG. 3 shows the flanging roller 1, the transmission means 10 and their respective mounting, in a section A-A which is indicated in FIG. 1. The flanging roller 1 is formed as a shaft finger comprising a shaft journal which protrudes into a bore of the transmission means 10 and is mounted, such that it can be rotated about the rotational axis $R_1$, in a bearing which is accommodated in the bore. The shaft journal is thickened at its free end with respect to the flanging region, which forms the rolling area during flanging, of the flanging roller 1 which as a whole protrudes out of the transmission means 10 in the manner of a finger. As an alternative to the rotary mounting shown, the shaft journal could be formed by an axial journal which is non-rotationally connected to the transmission means 10, and the flanging roller 1 could accordingly be rotationally mounted on such an axial journal via an internal rotary bearing. The embodiment shown is, however, preferred.

The pivot mounting of the transmission means 10 is obtained by means of an axial journal 7 which extends along the pivoting axis S and is non-rotationally connected to the arm 3. The transmission means 10 is mounted in a simple slide bearing, such that it can be rotated on the axial journal 7. A coupling means is formed on the end of the transmission means 10 facing away from the flanging roller 1, by means of which the flanging force $F_1$ to be absorbed during flanging is introduced into a counter bearing. The coupling means comprises: a rotary joint element 11 which extends transverse to the rotational axis $R_1$ and can be rotated relative to the transmission means 10 and extends through a bore or semi-bore of the transmission means 10, transverse to the rotational axis $R_1$, in the example embodiment parallel to the pivoting axis S, and; a sliding element 12 which is non-rotationally connected to the joint element 11. The sliding element can alternatively also be rotatably connected to the rotary joint element. If the sliding element 12 is rotatably connected to the rotary joint element 11, the rotary joint element 11 can in another alternative be non-rotationally connected to the transmission means 10.

Figure 4:
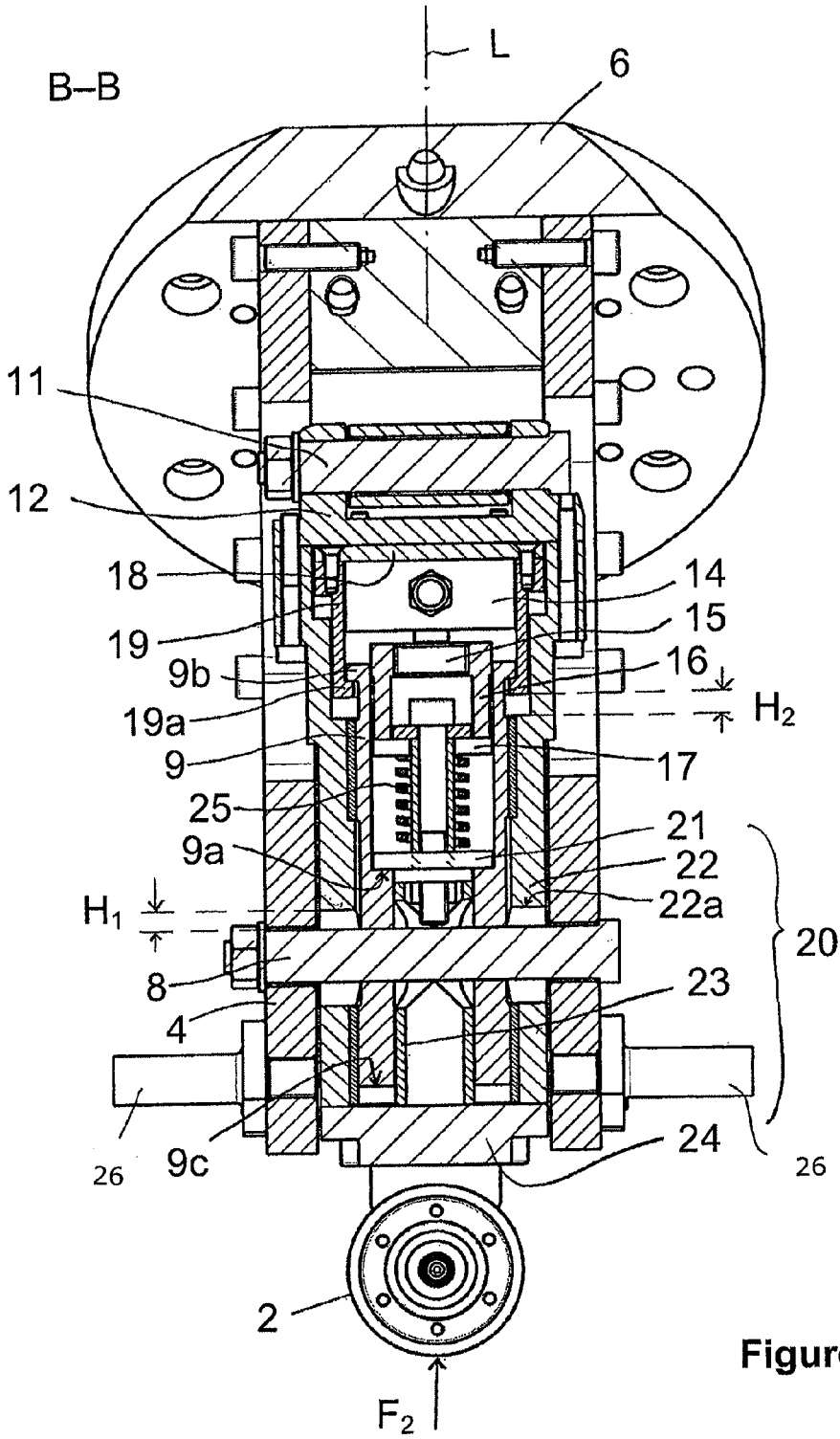
FIG. 4 the section B-B in FIG. 1.

FIG. 4 shows the section B-B, likewise indicated in FIG. 1, in which the axis L extends. The flanging roller 2 is supported via the transmission means 20 along the axis L on a spring 25 on which the flanging roller 1 is also supported in the counter direction via the transmission means 10 and the coupling means. The spring 25 acts as a pressure spring along the axis L, i.e. the axis L also simultaneously forms the spring axis. In the example embodiment, it is shaped as a spiral spring. In the direction of the flanging roller 2, the spring 25 is supported via a supporting element 21 on an abutment 9*a* of a tension member 9. The tension member 9 is connected to the bearing structure 3-6 such that it cannot be moved relative to it at least axially, i.e. parallel to the axis L. In the example embodiment, the axially rigid connection is produced by means of a connecting element 8. In the axial counter direction, the spring 25 is supported via a supporting element 17 on a transmission element 16 and the latter is supported via a load cell 14 on a bearing element 18 on which the coupling means acts counter to the force of the spring. The bearing element 18 forms the counter bearing for the coupling means. The bearing element 18, together with another tension member 19, forms a counter holder for the spring 25. It is fixedly connected to the tension member 19. The two tension members 9 and 19 are axially tensed against each other by the spring 25. They grip behind each other in order to transmit the tension force via abutments 9*b* and 19*a* formed by collars. The tension member 19 can be axially moved relative to the tension member 9, against the force of spring 25.

The transmission means 20 comprises an outer structure 22, an inner structure which acts as a plunger 23, and a cover 24 which faces the flanging roller 2 and is placed onto the outer structure 22 and the plunger 23 and transmits the flanging force $F_2$ onto the outer structure 22 and the plunger 23. During flanging, the plunger 23 acts on the supporting element 21 in the direction of the flanging force $F_2$.

The coupling means lies loosely on the bearing element 18 in a sliding contact. By means of this loose bearing and the rotatability of the sliding element 12 relative to the transmission means 10, the pivoting movement of the transmission means 10 is initially transmitted along the axis L onto the bearing element 18 and from there via the load cell 14, a setting element 15, for example a setting screw, the transmission element 16 and the supporting element 17 onto the spring 25. The connecting element 8 forms an abutment for the first flanging roller 1, by the outer structure 22 forming a counter abutment 22*a* in the region of a bore through which the connecting element 8 extends, acting as an abutment, said counter abutment 22*a* limiting the pivoting movement of the transmission means 10 and thus the flanging roller 1.

Figure 5:
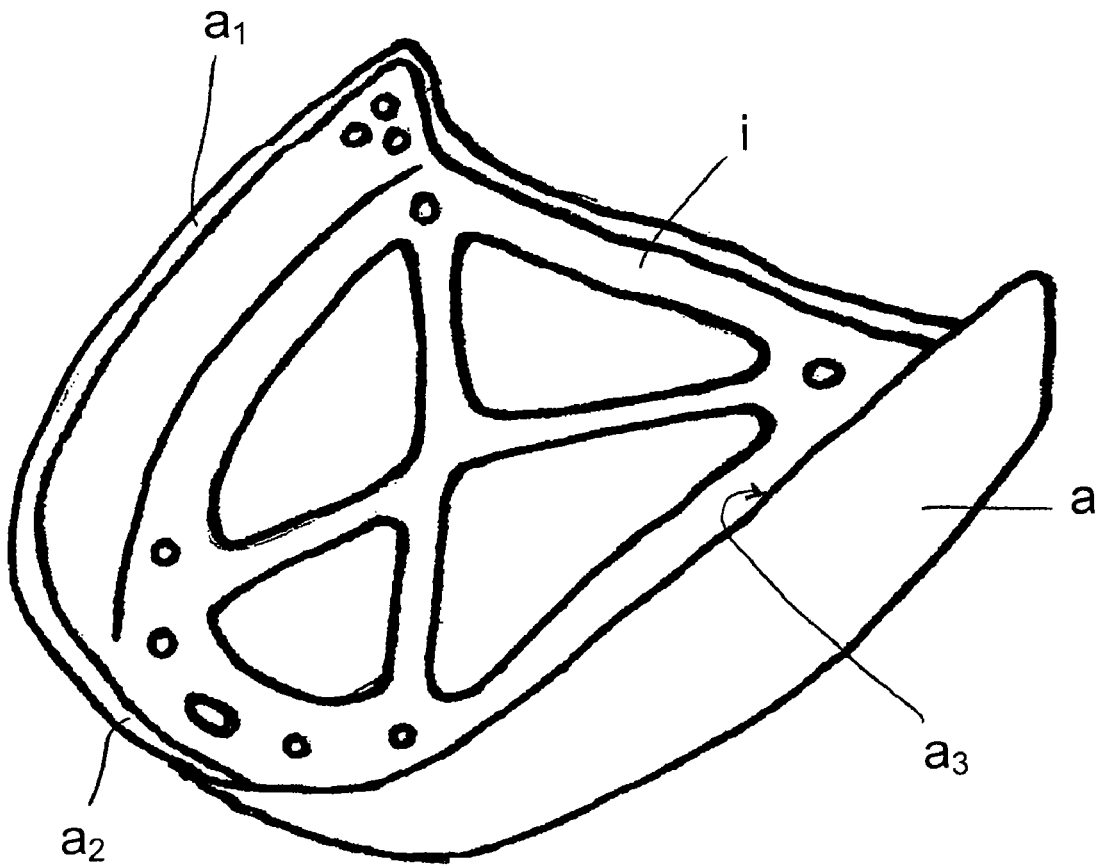
FIG. 5 a component part composite which can be manufactured by roll-hemming using the roll-flanging tool.

FIG. 5 shows a component part composite consisting of an outer part a and an inner part i. The component parts a and i are fixedly connected to each other by means of a hemmed connection along an outer peripheral strip of the outer part a in order to produce an engine bonnet for an automobile. The component parts a and i are metal sheet parts. The inner part i is placed into the outer part a, and its outer periphery passes along the two sides and, in the frontal region of the engine bonnet, into the peripheral strip of the outer part, up to a flanging web which forms the outer periphery of the peripheral strip. The flanging web is completely folded over in a plurality of flanging steps by means of the roll-flanging tool, and the fixed hemmed connection is produced in this way. In cross-section, the component parts i and a exhibit the shape of a flat trough over most of their length, which becomes flatter towards the front and eventually tapers out. The peripheral strip in which the flanging web runs thus points on both sides at an angle—in the example embodiment, roughly at a right angle—to the adjacent middle region with which the engine bonnet, once installed, subsequently covers the engine compartment of the automobile, and extends the middle region towards the front in accordance with the curve of the bonnet. The peripheral strip in which the flanging web is to be folded over accordingly comprises three different longitudinal portions, i.e. on one side a longitudinal portion comprising a flanging web portion $a_1$, in the frontal region a middle longitudinal portion comprising a flanging web portion $a_2$, and on the other side a longitudinal portion comprising a flanging web portion $a_3$. The two lateral longitudinal portions of the peripheral strip point roughly at a right angle to the middle longitudinal portion in the frontal region.

The flanging tool, with its two projecting arm assemblies and the flanging rollers 1 and 2 arranged on the respective ends of said arms, is specifically adapted for flanging such component parts and/or component part composites. The flanging roller 1 is used for flanging in the two lateral longitudinal portions of the peripheral strip, i.e. for folding over the flanging web portions $a_1$ and $a_3$, while the flanging web portion $a_2$ in the frontal region is folded over in a plurality of flanging steps using the flanging roller 2.

In order to flange the two lateral flanging web portions $a_1$ and $a_3$, the actuator places the flanging roller 1 of the roll-flanging tool onto the respective flanging web portion $a_1$ or $a_3$. The flanging roller 1 is then rolled off along the flanging web portion $a_1$ or $a_3$ in question, thus folding over the flanging web portion in question in accordance with the angular position of the rotational axis $R_1$. When flanging the lateral flanging web portions $a_1$ and $a_3$, the tool assumes an angular position in which the arm assembly comprising the flanging roller 2 projects outwards as viewed from the component parts a and i, i.e. the flanging force $F_1$ acts on the flanging roller 1 as shown in FIG. 1. The flanging web portions $a_1$ and $a_3$ are folded further over in a plurality of flanging steps, for example by 30° or 45°, respectively, and completely folded over in the last flanging step of final flanging, i.e. pressed onto the periphery of the inner part i. In order to flange the middle flanging web portion $a_2$, the actuator pivots the tool into an angular position in which the flanging roller 2 rolls off on the middle flanging web portion $a_2$ in accordance with the orientation of the middle flanging web portion $a_2$. The flanging web portion $a_2$ is likewise folded over in a plurality of flanging steps using the flanging roller 2, successively by an angle of for example 30° or 45° in each case, and completely folded over in a last flanging step of final flanging, wherein it is pressed onto the periphery of the inner part i. During flanging using the flanging roller 2, the tool can be orientated such that the arm assembly comprising the flanging roller 1 is situated above the inner part i while the final flanging step is being performed; preferably, however, the arm assembly points outwards away from the component part composite a, i.

The roll-flanging tool can be used for flanging component parts which are accommodated in a hemming bed. For flanging, it is assumed that the hemming bed is arranged stationary and the tool is orientated by the actuator in accordance with the angular position of the respective flanging web portion once the respective flanging step has been performed and is moved in accordance with the profile of the respective flanging web portion in its longitudinal direction. The arrangement can however also be reversed, by arranging the flanging tool stationary during flanging and instead correspondingly orientating and spatially moving the hemming bed comprising the component parts a and i. In such embodiments, a stationary framework replaces the actuator. This means that the tool is suitable for being connected to an actuator which can be moved spatially, but can also conversely be arranged stationary for flanging.

The spring 25 is installed with a bias which is larger than the flanging force $F_1$ or $F_2$ which acts during the flanging step(s) which proceed(s) final flanging. Thus, the spring 25 does not yield in the preceding flanging step(s); the arrangement can be regarded as rigid. During final flanging, however, the respective flanging web portion is rolled over with a force which exceeds the bias, i.e. the spring 25 elastically deflects during final flanging.

During final flanging using the flanging roller 1, the flanging force $F_1$ which is exerted or, in the counter direction, absorbed is transmitted onto the bearing element 18 by means of the transmission means 10 and the coupling means. If the biasing force of the spring 25 is exceeded, the bearing element 18 is moved together with the tension member 19 relative to the tension member 9, which is rigidly connected to the bearing structure 3-6, and relative to the arm 4 towards the connecting element 8. The force acting on the bearing element 18 is transmitted by the bearing element 18 onto the load cell 14 and from there via the setting element 15 and the transmission element 16 onto the supporting element 17 and from there directly onto the spring 25. Since the spring 25 is fixed on the abutment 9*a* via the other supporting element 21, it elastically deflects in accordance with the force transmitted. The connecting element 8 forms an abutment for the elastic deflection in this direction. For this purpose, the outer structure 22 forms the counter abutment 22*a*. The maximum stroke and/or spring path for this direction of elastic deflection is indicated by $H_1$. In relation to the coupling between the coupling means and the bearing element 18, it should also be noted that the bolts which can be seen in FIG. 4 to the left and right of the counter holder are merely guiding bolts for the purely sliding contact between the sliding element 12 and the bearing element 18 and guide the elements 12 and 18 linearly on each other in a sliding contact, normal with respect to the axis L, i.e. they do not transmit any tension force.

If flanging is being performed using the flanging roller 2, and the flanging force $F_2$ exceeds the biasing force of the spring 25 during final flanging, the transmission means 20 performs a linear retracting movement along the axis L, wherein its plunger 23 presses against the supporting element 21 which lifts off the abutment 9*a* when the spring 25 elastically deflects. The spring force is absorbed by the supporting element 17 which is supported in this direction on the bearing element 18 via the transmission element 16, the setting element 15 and the load cell 14 when the spring 25 is charged. The bearing element 18 is connected to the tension member 19 such that it is fixed, at least tensilely fixed, such that the force absorbed by the spring 25 is absorbed by the tension member 9 via the pair of abutments 9*b*, 19*a* and finally by the bearing structure 3-6 via the connecting element 8. The maximum spring path and/or stroke $H_2$ in this direction is predetermined by the abutment of the outer structure 22 on the abutment 19*a* of the tension member 19.

The flanging roller 1 acts on the spring 25 via two lever arms of the same length, i.e. the pivoting axis S exhibits the same distance from the axis L as from an imaginary center of force of the flanging roller 1 in which the entire force $F_1$ acting on the flanging roller 1 during flanging acts if the linearly acting force is conceived as being replaced by an individual force. Due to these leverages, forces $F_1$ and $F_2$ of the same magnitude will also produce spring forces of the same magnitude.

Two placing elements 26 are arranged on the second arm assembly, in the example embodiment on the arm 4 of the bearing structure 3-6, and project from the arm assembly in mutually opposite directions. The placing elements 26 are slim, in the shape of rods. Using the placing elements 26, the actuator can press against the flanging web in restricted regions which are not accessible to the flanging rollers 1 and 2 due to their size.

In the example embodiment, the roll-flanging tool is fitted with only one of each of the flanging roller 1 and flanging roller 2. In one modification, a plurality of first flanging rollers 1 can be arranged on the arm assembly, preferably on the transmission means 10, and mounted such that they can be rotated about first rotational axes $R_1$ which are parallel to each other. The rotational axes $R_1$ of such a plurality of first flanging rollers 1 can be fixed with respect to the body or can be adjustable in parallel. The adjustability can in particular be designed such that each of the first flanging rollers 1 can optionally be adjusted into the position of the one flanging roller 1 in the example embodiment. In another modification, a plurality of second flanging rollers 2 can be provided on the arm assembly, preferably each on the transmission means 20. The two or even more second flanging rollers 2 can in particular be arranged such that their rotational axes $R_2$ point at an angle to each other, for example at a right angle. The second rotational axes $R_2$ are expediently at a right angle to the axis L, such that the force which acts during flanging is flush with the spring axis of the spring 25 or at least spaced apart from it in parallel. The second flanging rollers can be arranged on the roll-flanging tool, stationary or adjustable. If the flanging rollers 2 are adjustable, the adjustability is preferably such that each of the flanging rollers 2 can optionally be adjusted, for flanging, into a position in which the rotational axis $R_2$ of the flanging roller 2 in question intersects the axis L. The roll-flanging tool can exhibit both modifications or only one of said two modifications.

The invention claimed is:

1. A roll-flanging tool, comprising:

a bearing structure comprising a connection means for a connection to an actuator which can be moved spatially;

a spring which is mounted by the bearing structure;

a first flanging roller which is mounted by the bearing structure such that it can be rotated about a first rotational axis and moved transverse to the first rotational axis against a force of the spring;

a second flanging roller which is mounted by the bearing structure such that it can be rotated about a second rotational axis and moved transverse to the second rotational axis, likewise against the force of the spring;

a first transmission means which is movably connected to the bearing structure and on which the first flanging roller is supported such that it can be rotated about the first rotational axis and which transmits a flanging force, which acts on the first flanging roller, transverse to the first rotational axis, onto the spring, against the force of the spring, in a first direction; and a second transmission means which is movably connected to the bearing structure and on which the second flanging roller is supported such that it can be rotated about the second rotational axis and which transmits a flanging force, which acts on the second flanging roller, transverse to the second rotational axis, onto the spring, against the force of the spring, wherein the first rotational axis intersects or crosses a perpendicular dropped onto the second rotational axis, in or on the roll-flanging tool.

2. The roll-flanging tool according to claim 1, wherein the transmission means are designed such that in the case of flanging forces of the same magnitude, they each transmit a force which is the same in terms of its magnitude onto the spring, wherein a flanging force which acts on the first flanging roller in one run is compared with a flanging force which acts on the second flanging roller in another run.

3. The roll-flanging tool according to claim 1, wherein the first transmission means is connected to the bearing structure such that it can be pivoted about a pivoting axis which points transverse to the first rotational axis.

4. The roll-flanging tool according to claim 3, wherein the first transmission means is a pivoting lever comprising a first lever arm which points towards the first flanging roller from the pivoting axis and a second lever arm which points towards the connection plane and is mechanically coupled to the spring.

5. The roll-flanging tool according to claim 4, wherein the lever arms are of the same length.

6. The roll-flanging tool according to claim 1, wherein the second transmission means is connected to the bearing structure such that it can be linearly moved transverse to the second rotational axis.

7. The roll-flanging tool according to claim 1, wherein the spring is arranged such that it can be tensed along a spring axis and is supported with a bias in one direction of the spring axis on a first abutment which cannot be moved along the spring axis relative to the bearing structure, and in the other direction on a counter holder which can be moved back and forth along the spring axis and is pressed by the spring in the other direction of the spring axis against a second abutment which cannot be moved along the spring axis relative to the bearing structure and one of the transmission means acts on the counter holder in one direction, against the force of the spring, and the other of the transmission means acts on the spring in the other direction.

8. A roll-flanging tool, comprising:

a bearing structure comprising a connection means for a connection to an actuator which can be moved spatially;

a spring which is mounted by the bearing structure;

a first flanging roller which is mounted by the bearing structure such that it can be rotated about a first rotational axis and moved transverse to the first rotational axis against a force of the spring; and a second flanging roller which is mounted by the bearing structure such that it can be rotated about a second rotational axis and moved transverse to the second rotational axis, likewise against the force of the spring, wherein the spring is supported on a load cell, and wherein the spring is arranged such that it can be tensed in two mutually opposite directions, fixed in one of these directions relative to the bearing structure on an abutment, and supported in the other of these directions on the load cell, and in that one of the flanging rollers acts on the spring in one of these directions during flanging and the other of the flanging rollers acts on the spring in the other of these directions during flanging.

9. A roll-flanging tool, comprising:

a bearing structure comprising a connection means for a connection to an actuator which can be moved spatially;

a spring which is mounted by the bearing structure;

a first flanging roller which is mounted by the bearing structure such that it can be rotated about a first rotational axis and moved transverse to the first rotational axis against a force of the spring; and a second flanging roller which is mounted by the bearing structure such that it can be rotated about a second rotational axis and moved transverse to the second rotational axis, likewise against the force of the spring, wherein the spring is arranged such that it can be tensed along a spring axis and is supported with a bias in one direction of the spring axis on a first abutment which cannot be moved along the spring axis relative to the bearing structure, and in the other direction on a counter holder which can be moved back and forth along the spring axis and is pressed by the spring in the other direction of the spring axis against a second abutment which cannot be moved along the spring axis relative to the bearing structure.

* * * * *

UNITED STATES PATENT AND TRADEMARK OFFICE

CERTIFICATE OF CORRECTION

PATENT NO. : 8,408,036 B2
APPLICATION NO. : 12/601624
DATED : April 2, 2013
INVENTOR(S) : Stefan Reith et al.

It is certified that error appears in the above-identified patent and that said Letters Patent is hereby corrected as shown below:

On the Title Page, Item (73), Assignee: "Edag" should read --EDAG--

On the Title Page, Item (30), Foreign Application Priority Data: "Jul." should read --June--

Signed and Sealed this
Twenty-eighth Day of May, 2013

Teresa Stanek Rea
*Acting Director of the United States Patent and Trademark Office*

UNITED STATES PATENT AND TRADEMARK OFFICE

CERTIFICATE OF CORRECTION

PATENT NO. : 8,408,036 B2
APPLICATION NO. : 12/601624
DATED : April 2, 2013
INVENTOR(S) : Reith et al.

It is certified that error appears in the above-identified patent and that said Letters Patent is hereby corrected as shown below:

On the Title Page:

The first or sole Notice should read --

Subject to any disclaimer, the term of this patent is extended or adjusted under 35 U.S.C. 154(b) by 711 days.

Signed and Sealed this
First Day of September, 2015

Michelle K. Lee

Michelle K. Lee
*Director of the United States Patent and Trademark Office*